United States Patent [19]

Condon

[11] Patent Number: 4,787,276

[45] **Date of Patent: * Nov. 29, 1988**

[54] TOOL HANDLE WITH INTERCHANGEABLE BLADES AND ALTERNATE ORIENTATION

[76] Inventor: Harry F. Condon, 147 S. Howell, Hillsdale, Mich. 49242

[ * ] Notice: The portion of the term of this patent subsequent to Feb. 3, 2004 has been disclaimed.

[21] Appl. No.: 48,372

[22] Filed: May 11, 1987

[51] Int. Cl.[4] ..... B25G 1/06

[52] U.S. Cl. ..... 81/177.1; 81/177.2; 81/177.8

[58] Field of Search ..... 81/177.1, 177.8, 177.2, 81/177.4, 177.5, 177.85, 489, 490, 436–440; 279/14, 93, 102

[56] References Cited

U.S. PATENT DOCUMENTS

| | | | |
|---|---|---|---|
| 1,215,308 | 2/1917 | Johnson | 81/177.4 X |
| 1,578,065 | 3/1926 | Bemus et al. . | |
| 1,744,413 | 1/1930 | Peterson et al. | 81/177.1 |
| 2,182,673 | 12/1939 | Magnano | 145/61 |
| 2,569,069 | 9/1951 | Motel | 145/50 |
| 2,821,403 | 1/1958 | Bevan | 279/14 |
| 3,113,479 | 12/1963 | Swingle | 81/177.2 |
| 3,850,056 | 11/1974 | Allen | 81/71 |
| 4,056,020 | 11/1977 | Coviello | 81/177 A |
| 4,640,155 | 3/1987 | Condon | 81/439 |

*Primary Examiner*—Debra Meislin

*Attorney, Agent, or Firm*—Beaman & Beaman

[57] ABSTRACT

A hand tool for transmitting torque having a handle wherein a tool implement blade may be alternately mounted in three positions on the handle. A slot defined at one end of the handle permits the implement having a shaped head fixed thereon to be mounted such that the implement axis is parallel or transversely related to the handle axis, and a recess formed in the handle central region receives the implement head to permit the tool to be centrally located on the handle and transverse thereto to permit "spinning" of the implement. A retainer rotatably mounted upon the handle prevents inadvertent release of the implement from the slot and a spring biased plunger prevents inadvertent release of the implement from the central recess.

7 Claims, 2 Drawing Sheets

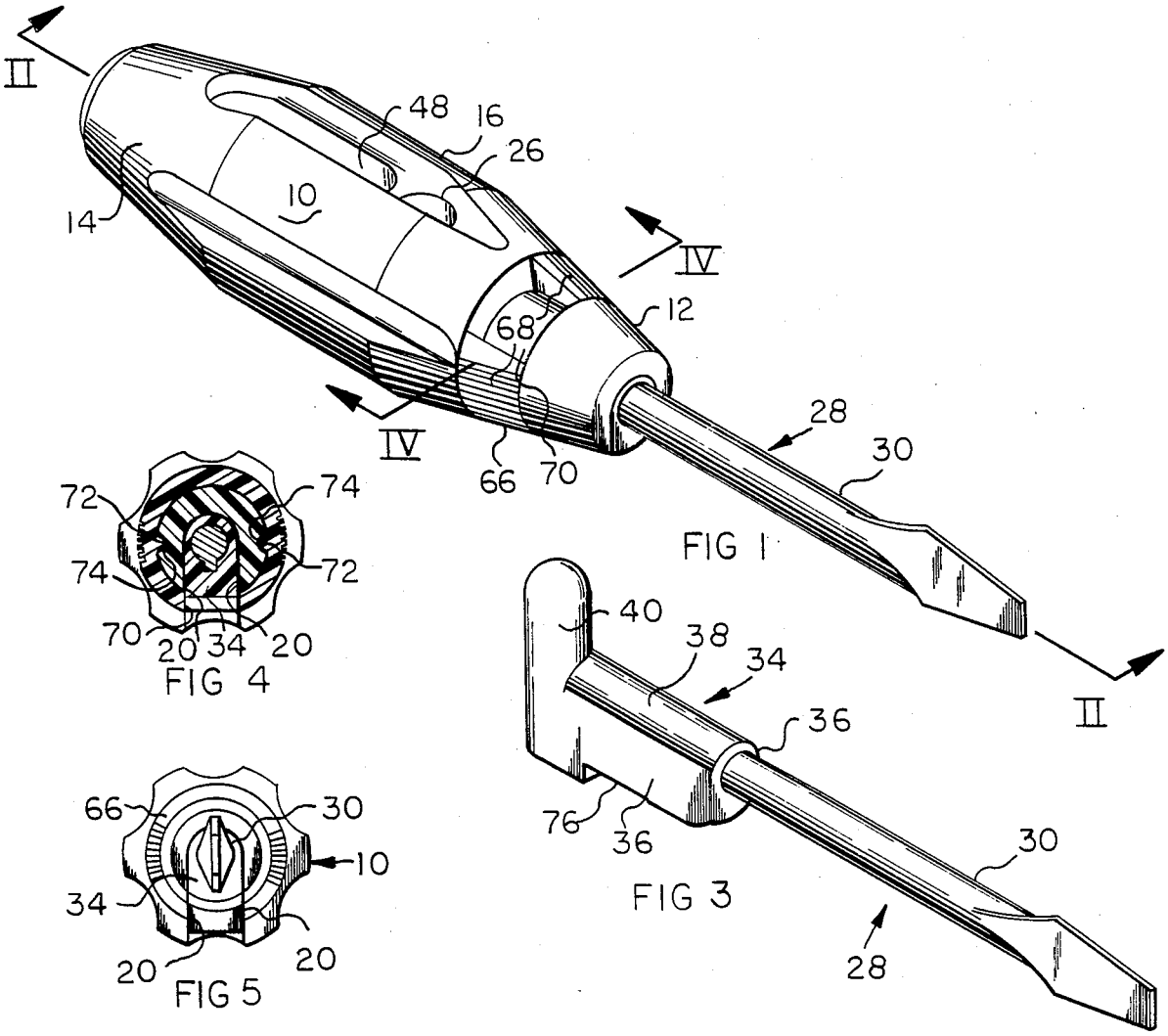
FIG 1
FIG 3
FIG 4
FIG 5
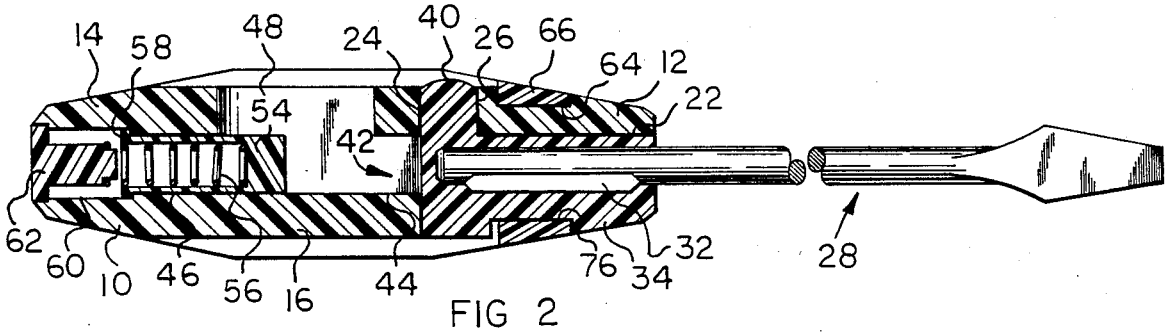
FIG 2
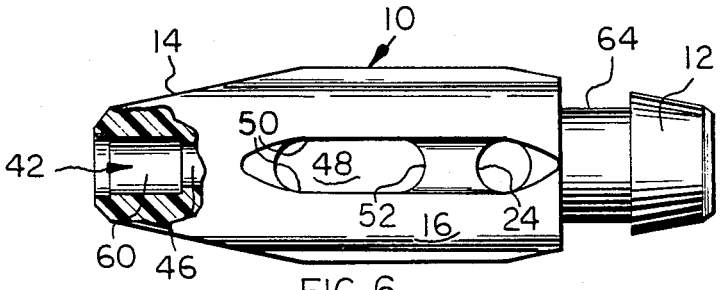
FIG 6

TOOL HANDLE WITH INTERCHANGEABLE BLADES AND ALTERNATE ORIENTATION

BACKGROUND OF THE INVENTION

A hand tool, such as used as a screwdriver or wrench, wherein the tool implement blade may be alternately mounted on the handle in an axial relationship, or in a transverse relationship forming a "pistol" grip, is shown in my U.S. Pat. No. 4,640,155. In this patent a slot is formed in one end of the implement blade, and the head includes a projection received within an opening defined in the handle transversely related to the implement axis preventing withdrawal of the implement in the direction of its axis.

The hand tool of the foregoing patent permits the implement to be related to the handle in a "pistol grip" manner permitting high torque to be transferred to the implement blade, but as the pistol grip assembly mode does not locate the axis of the implement at the center of the handle length, an uneven weight distribution exists relative to the implement and "spinning" of the implement to accelerate implement rotation is not readily accomplished.

Also, the hand tool of the aforementioned patent relies upon friction to maintain the implement head within the handle slot with respect to radial movement of the head when the implement was axially related to the handle, and over long periods of use the frictional interrelationship between the handle slot and implement head diminishes, reducing the effectiveness of the implement head retention in the handle.

It is an object of the invention to provide a hand tool having a handle wherein a torque transferring implement blade may be alternately mounted upon the handle in three operative positions such that an elongated implement may be attached to the handle coaxial therewith, in a pistol grip relationship to the handle, or in a symmetric transverse Tee relationship to the handle to permit the transfer of high torque and spinning.

Another object of the invention is to provide a hand tool having a handle in which a radial slot is defined intersecting a handle end and the slot closely selectively receives a head formed on an elongated implement blade in two alternate positions to improve ease of use and maximize torque transfer, and wherein a retainer is mounted on the handle positionable to prevent inadvertent removal of the implement head from the slot.

Yet another object of the invention is to provide a hand tool having a molded handle having a central region wherein the central region includes a shaped recess for receiving a head defined upon an elongated implement blade wherein the implement may be symmetrically related to the handle to facilitate "spinning" and wherein retaining means located within the handle prevent inadvertent release of the implement head from the recess.

Another object of the invention is to provide a molded hand tool handle having a slot and a recess defined therein for selectively receiving the molded head of an elongated implement in one of three alternate relationships wherein the implement may be associated with the handle in an axial manner, a pistol grip manner, or a symmetrical Tee manner.

In the practice of the invention a tool handle preferably molded of a synthetic plastic material includes an axis and front and rear ends. A radial slot intersects the handle front end and includes parallel spaced sides radially offset with respect to the handle axis. An elongated metal implement, such as a screwdriver blade or an Allen wrench, includes an inner end having a synthetic plastic head molded thereon which is fixed to the implement and is of a configuration permitting the head to be closely received within the handle slot in a torque transfer relationship. The implement head includes a projection extending transverse to the length of the implement blade receivable within an opening intersecting the slot, and the projection and opening prevents withdrawal from the handle slot in a direction parallel to the axis of the implement.

An annular retainer ring rotatably mounted within a groove defined in the handle front end overlies or engages the implement head when received within the slot preventing release from the slot. The retainer ring includes an interrupted circumference defining an opening which may be aligned with the slot to permit release of the implement head therefrom. Detent structure defined on the retainer ring and handle maintains the ring in the desired rotative position.

Additionally, a radially extending recess is defined in the handle central region having flat parallel spaced sides for closely receiving the implement head, and a bore defined in the handle receives the head projection to prevent radial withdrawal of the implement from the recess. When fully received within the recess, the implement blade will be symmetrically related to the length of the handle to permit spinning of the implement, and in the preferred embodiment a spring-biased plunger within the handle biases the implement head in the direction maintaining the head projection within the handle bore.

BRIEF DESCRIPTION OF THE DRAWINGS

The above objects and advantages of the invention will be appreciated from the following description and accompanying drawings wherein:

FIG. 1 is a perspective view of a hand tool in accord with the invention illustrating the implement blade mounted axially with respect to the handle, FIG. 2 is an elevational, sectional view of the hand tool of FIG. 1 as taken along Section II—II thereof with the retainer ring in the implement retaining position, FIG. 3 is a perspective view of the implement, per se, FIG. 4 is an elevational, sectional view taken through the retainer ring along Section IV—IV of FIG. 1 with the ring in the implement release position, FIG. 5 is an elevational view of the tool as taken from the implement end as from the right of FIG. 1, FIG. 6 is a plan view of the handle, per se, partially in section, the retainer ring being removed from its groove.

DESCRIPTION OF THE PREFERRED EMBODIMENTS

Figure 7:
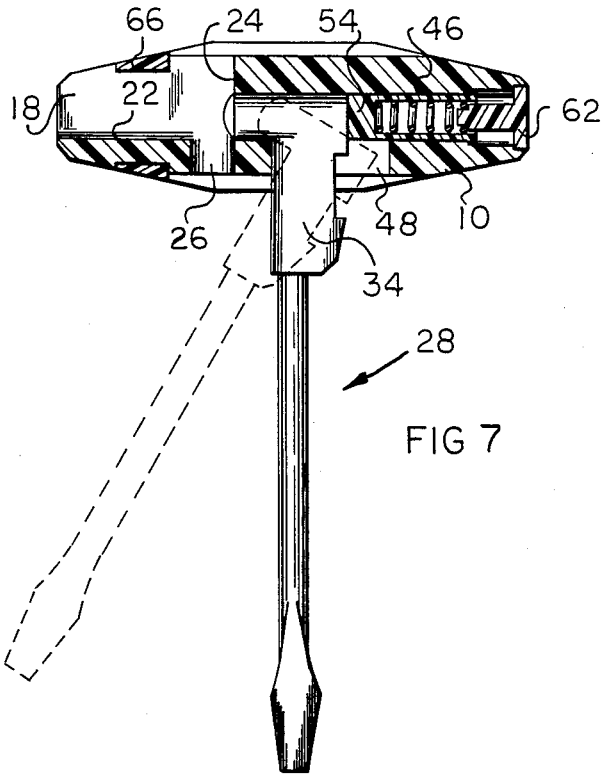
FIG. 7 is an elevational view, partially sectioned, illustrating the hand tool in full lines assembled in a Tee configuration, the position of the implement blade being shown in dotted lines during a partially assembled condition.

With reference to FIGS. 1–6, a hand tool constructed in accord with the invention includes a handle 10 preferably molded of a synthetic plastic material having longitudinal ribs formed thereon. The handle includes a front end 12, a rear end 14 and a central region 16, and the elongated configuration is concentric to its longitudinal axis.

The handle 10 includes a slot 18 defined at its front end consisting of spaced parallel sides 20 and a cylindrical segment surface 22 concentric with the handle axis, FIG. 4. The slot 18 intersects both the front end of the handle and the lateral portion of the handle adjacent the front end and inwardly axially terminates in a cylindrical segment surface 24, FIG. 2. The surface 24 constitutes a portion of a cylindrical opening 26 which intersects the exterior surface of the handle.

The tool implement 28 is illustrated as constituting a screwdriver blade 30 but may consist of a hexagonal Allen wrench, or the like. The blade 30 is of an elongated configuration having a longitudinal axis, and at its inner end is swaged to form a radially extending wing 32 whereby upon molding the synthetic plastic head 34 upon the blade inner end a torque transmitting relationship therebetween is established. The head 34 includes spaced parallel lateral surfaces 36 for close reception and confirmation to the handle slot 18, and the head convex surface 38 corresponds to the slot surface 22. A radially extending cylindrical projection 40 is of a diameter slightly less than that of opening 26 and is received within the opening when the head is assembled to the handle as shown in FIGS. 1 and 2. The aforementioned slot and implement configurations and relationships are identical to those described in U.S. Pat. No. 4,640,155.

The handle 10 includes an axially extending cylindrical bore 42 having a portion 44 which intersects the slot 18, and a portion 46 disposed toward the handle rear end. A radially extending recess 48 is defined in the handle central region 16 and intersects the bore 42 as will be appreciated from FIG. 2. The recess 48 is defined by spaced parallel sides 50 which closely cooperate with the implement head surfaces 36 when the head is inserted therein, and the recess includes a semi-cylindrical concave surface 52 having a radius equal to the radius of the opening 26 which is also equal to the radius of the bore 42.

By tilting the implement 28 to the angle shown in dotted lines in FIG. 7, the implement head 34 may be inserted in the recess 48 and pivoted counterclockwise so that the projection 40 is received within bore portion 44 and the length of the blade 30 will be disposed at right angles to the axial length of the handle as shown in full lines in FIG. 7. The recess 48 is positioned in the central region of the handle such that when the implement head is fully received within the recess as shown in FIG. 7, the axis of the blade will lie within a plane bisecting the central region such that the blade will be symmetrically related to the length of the handle. This relationship, which produces a Tee mode of operation, permits the handle 10 to be spun to rapidly rotate the blade during use.

The synthetic plastic plunger 54 is reciprocally mounted within the bore portion 46 and includes a cavity receiving a compression spring 56. The plunger 54 includes a stop shoulder 58 reciprocal within the bore enlarged portion 60, and a plug 62 located within the enlarged portion and bonded therein anchors an end of the spring for biasing the plunger into the recess 48. When the head 34 is being inserted into the recess 48, FIG. 7, pivoting of the implement biases the plunger 54 to the right permitting the implement to be fully inserted in the recess, and thereupon, the plunger will be biased against the head to maintain the projection 40 within bore portion 44. To remove the implement from the recess the implement head is moved axially against the plunger 54 compressing the spring 56 and clockwise tilting of the implement, FIG. 7, permits the implement head to be readily removed from the handle recess.

The handle 10 is also provided with an annular groove 64 adjacent the front end 12. The groove 64 receives a synthetic plastic retaining ring 66 rotatable therein and exteriorly, the ring is provided with ribs 68 to facilitate manual ring rotation. The circumference of the ring 66 is interrupted to form an opening 70 of a circumferential dimension corresponding to the width of the slot 18.

Detent structure is interposed between the handle 10 and retainer ring 66 and takes the form of small rounded knobs or protrusions 72 defined on the ring which are receivable within small depressions 74 defined on the base surface of the groove 64, FIG. 4, and the depressions and protrusions will cooperate to maintain the ring opening 70 in alignment with the slot 18, FIG. 4, when it is desired to remove the implement head 34 from the slot 18. Upon rotation of the retainer ring, the protrusions will ride out of the depressions and a 180° rotation of the ring 66 causes the ring to overlie the slot 18 thereby preventing radial displacement of the head relative to the handle. Thus, the retaining ring detent structure permits indexing of the ring to the implement release position of FIG. 4, and also maintains the indexing of the ring to its implement head retaining position.

As will be appreciated from FIGS. 2 and 3, the head 34 is provided with a notch 76 which aligns with the groove 64 and ring 66, and the notch permits accommodation of the retainer ring.

Figure 8:
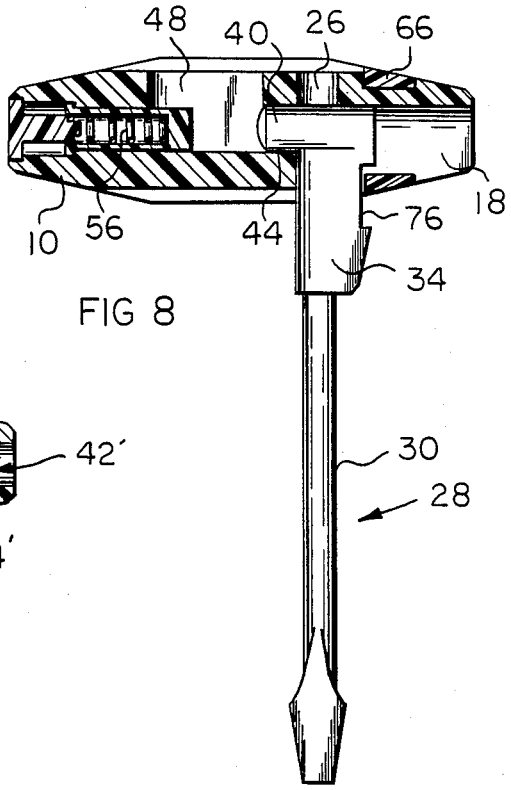
FIG. 8 is an elevational view, partially sectioned, illustrating the handle and implement blade assembled in a pistol grip mode.

When the implement 28 is mounted to the handle 10 in the "pistol grip" embodiment shown in FIG. 8, the head projection 40 will be received within the bore portion 44, and the location of the retaining ring 66 and the head notch 76 is such that the retaining ring, when rotated to its head retaining position, is received within the notch and will prevent movement of the head to the right in the axial direction of the handle as shown in FIG. 8.

It will therefore be appreciated that when the implement is in the "straight" or axial relationship to the handle as shown in FIGS. 1 and 2, the head projection 40 prevents relative axial movement between the handle and implement while the retainer ring 66 prevents relative radial movement. When the components are in the pistol grip mode of FIG. 8, the projection 40 prevents relative radial movement between the handle and implement and the retaining ring 66 prevents relative axial movement on the handle. In this manner the combination of the head projection and the retainer ring positively locks the implement within the handle slot in either of these two modes.

Figure 9:
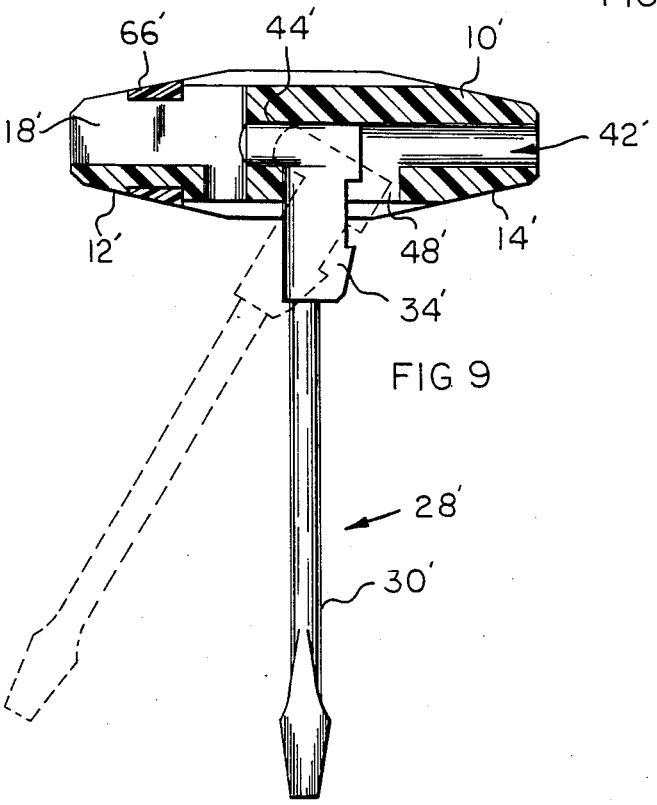
FIG. 9 is an elevational view, partially sectioned, of a simplified version of the hand tool of the invention, the operative implement position being shown in full lines, and the implement being shown in dotted lines during partial assembly.

The embodiment of FIG. 9 is identical to that discussed above in many respects, and identical components are indicated by primed reference numerals. The difference between the embodiment of FIG. 9 and that of FIGS. 1–8 is the deletion of the spring-biased plunger and associated components. The embodiment of FIG. 9 provides a hand tool having the attributes of the Tee assembled embodiment, and in most instances the frictional interrelationship between the implement head 34' and the recess 48' is sufficient to permit inadvertent release of the head from the recess.

It is appreciated that various modifications to the disclosed embodiments of the invention may be apparent to those skilled in the art without departing from the spirit and scope of the invention.

I claim:

1. A hand tool having a tool implement alternately positionable upon a handle comprising, in combination, an elongated handle having an outer surface, a longitudinal axis, a front end, a rear end and a central region bisected by a central plane perpendicular to said axis, an elongated axially extending radial slot defined in said handle laterally intersecting said handle outer surface and said handle front end and said slot having a configuration including opposed flat surfaces radially spaced from said handle axial axis, an elongated implement having an axis, an outer end and an inner end, torque drive means defined on said implement outer end, a head integrally fixed upon said implement inner end, a portion of said head having a configuration complementary to a portion of said slot in a first position and in a second position, said slot flat surfaces comprising spaced opposed flat parallel sides defined upon opposite sides of said handle axis and radially spaced relative thereto, said head including a pair of parallel sides spaced apart a distance substantially equal to the spacing of said opposed flat parallel sides thereby permitting said head to be closely received within said slot in said first position with said implement axis substantially coincident with said handle axis and alternately in said second position wherein said implement axis is transverse to said handle axis, and a radial recess defined in said handle central region of a configuration to closely receive said implement head in a third position, said recess including a pair of parallel sides spaced apart a distance substantially equal to the spacing of said opposed flat parallel sides whereby said implement axis will be radially disposed to said handle axis and located within said central plane.

2. In a hand tool as in claim 1, an axial bore defined in said handle concentric to said axis thereof intersecting said slot and said recess, an opening defined in said handle transverse to said handle axis intersecting said slot and of a configuration corresponding to said bore, an elongated projection defined on said head extending in a direction transverse to said implement axis, said projection being closely received within said opening at said head first position and closely received within said bore at said head second and third positions to prevent movement of said implement in the direction of its axis.

3. A hand tool having a tool implement alternately positionable upon a handle comprising, in combination, an elongated handle having an outer surface, an axis, a front end and a rear end, an elongated axially extending radial slot defined in said handle laterally intersecting said handle outer surface and said handle front end, said slot including spaced, opposed flat parallel sides defined upon opposite sides of said handle axis and radially spaced relative thereto, an elongated implement having an axis, an outer end and an inner end, torque drive means defined on said implement outer end, a head integrally fixed on said implement inner end, a portion of said head having a configuration complementary to a portion of said slot in a first position and in a second position, said head including a pair of spaced parallel sides spaced apart a distance substantially equal to the spacing of said slot's sides whereby said head may be firmly received within said slot in said first position wherein said implement axis is substantially parallel to said handle axis and extends from said handle front end and said second position wherein said implement axis is transversely disposed to said handle axis, an elongated projection defined on said head extending in a direction transverse to said implement axis, a first recess defined in said handle and intersecting said slot having a length transversely disposed to said handle axis, a second recess defined in said handle and intersecting said slot having a length substantially coaxial with said handle axis, said head projection being closely received within said first recess when said head is in said first position and closely received within said second recess when said head is in said second position, reception of said projection within said first or second recess preventing withdrawal of said head from said slot in a direction parallel to said implement axis, an implement retainer mounted on said handle adjacent said front end selectively positionable over said slot and said implement head when said head is in said first position preventing removal of said head from said slot in a radial direction parallel to the length of said projection.

4. In a hand tool as in claim 3, said retainer comprising an annular ring rotatably mounted upon said handle front end having a circumferential opening of a circumferential dimension slightly larger than that of said slot whereby alignment of said opening with said slot permits said head to be radially removed from said slot.

5. In a hand tool as in claim 4, an annular groove defined in said handle adjacent said front end, said ring being rotatably mounted within said groove.

6. In a hand tool as in claim 5, first and second detent means, respectively, defined on said handle and said ring engaging upon alignment of said ring opening with said slot.

7. In a hand tool as in claim 5, finger engaging means defined upon said ring to facilitate manual rotation thereof.

* * * * *